United States Patent [19]

Schwander et al.

[11] 4,251,471

[45] Feb. 17, 1981

[54] CARBURETOR FOR INTERNAL COMBUSTION ENGINES WITH AN ACCELERATION PUMP

[75] Inventors: Dieter Schwander, Ratingen; Hermann Strell, Moers; Bernd Findeisen, Dusseldorf, all of Fed. Rep. of Germany

[73] Assignee: Pierburg GmbH & Co. KG, Neuss, Fed. Rep. of Germany

[21] Appl. No.: 70,695

[22] Filed: Aug. 28, 1979

[30] Foreign Application Priority Data

Sep. 27, 1978 [DE] Fed. Rep. of Germany ..... 2841951

[51] Int. Cl.[3] ..... F02M 7/08

[52] U.S. Cl. ..... 261/34 A; 417/308

[58] Field of Search ..... 261/34 A, 34 B; 417/308

[56] References Cited

U.S. PATENT DOCUMENTS

| | | | |
|---|---|---|---|
| 2,235,797 | 3/1941 | Carlson | 261/34 A |
| 2,417,734 | 3/1947 | Carlson et al. | 261/34 A |
| 2,421,810 | 6/1947 | Simpson | 261/34 A |
| 2,458,990 | 1/1949 | Griffon | 261/34 A |
| 3,409,277 | 11/1968 | Reise | 261/34 R |
| 4,025,588 | 5/1977 | Nakamura et al. | 261/34 A |
| 4,075,294 | 2/1978 | Saito et al. | 261/34 A |

FOREIGN PATENT DOCUMENTS

| | | | |
|---|---|---|---|
| 2261557 | 12/1972 | Fed. Rep. of Germany | 261/34 B |
| 2420171 | 1/1975 | Fed. Rep. of Germany | 261/34 B |
| 1418587 | 12/1975 | United Kingdom | 261/34 A |

*Primary Examiner*—Tim R. Miles

[57] ABSTRACT

A carburetor for internal combustion engines with an acceleration pump whose pump chamber is connected to the float chamber by a suction duct having a suction valve. The pump chamber also is connected to the intake line section upstream of the throttle by a delivery duct having a pressure valve and a calibrated injection opening. The acceleration pump has a displacement member which is actuated via a linkage by a lever depending on the throttle position. The pump chamber has a flow duct, leading to the float chamber and having a cross section adjustable by means of a screw, and a second adjustable flow duct whose inlet has a valve actuated by the throttle position. The valve may have a spring which presses a closure member, held in a diaphragm, against the inlet overcoming the force of the fuel pressure. This spring also presses a plunger against a second lever arm which actuates the acceleration pump.

3 Claims, 2 Drawing Figures

CARBURETOR FOR INTERNAL COMBUSTION ENGINES WITH AN ACCELERATION PUMP

BACKGROUND OF THE INVENTION

The present invention relates to a carburetor for internal combustion engines with an acceleration pump whose pump chamber is connected to the float chamber by a suction duct containing a suction valve, and to the suction line section upstream of the throttle by a delivery duct containing a pressure valve and a calibrated injection opening. The acceleration pump has a displacement member which is actuated depending on the throttle position by means of a lever via a linkage.

Such devices are known, for example, from German Laid-Open Document No. 24 20 171, dated Jan. 2, 1975, where the injection is metered depending on the fuel temperature. However, with the known pumps it is impossible to adapt the acceleration quantity to the requirements of the engine and to the exhaust gas laws. During acceleration in the upper range, that is, with an acceleration based on a specific throttle opening, CO peak values are obtained when measuring the exhaust gases. This is due to the fact that the injected amount is too large. However, if the pump is adjusted so that the injected amount is reduced, it becomes too small for the lower range of throttle opening and the engine runs out of true.

Accordingly, it is an object of the present invention to provide a device which in the lower range of the throttle opening angle injects a larger adjustable volume than in the upper range.

Another object of the present invention is to provide an arrangement of the foregoing character which is substantially simple in construction and may be economically fabricated.

A further object of the present invention is to provide a carburetor, as described, which may be readily maintained in service and which has a substantially long operating life.

SUMMARY OF THE INVENTION

The objects of the present invention are achieved by a carburetor in which the pump chamber is provided with a flow duct to the float chamber with a cross section adjustable by a screw. A second adjustable flow duct has an inlet with a valve actuated by the position of the throttle. An advantageous embodiment provides that the valve has a spring which presses a closure member held in a diaphragm, overcoming the force of the fuel pressure, against the inlet, and also presses a plunger against a second arm of the lever actuating the pump.

The novel features which are considered as characteristic for the invention are set forth in particular in the appended claims. The invention itself, however, both as its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
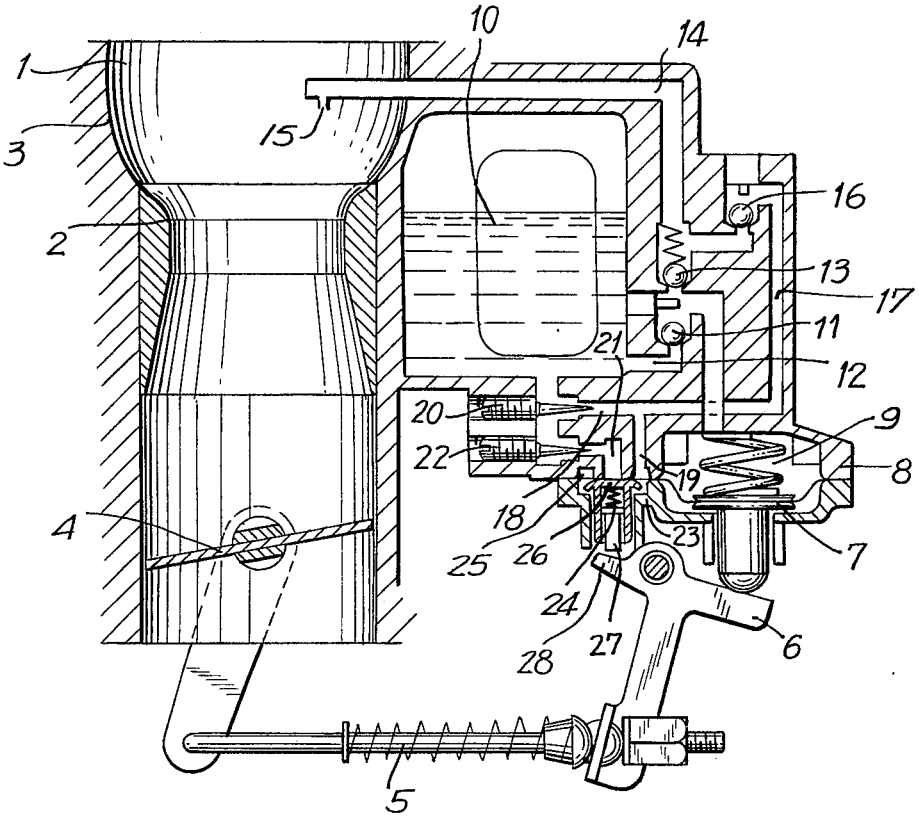
FIG. 1 shows a section through the carburetor according to the present invention.

The carburetor 1 is of conventional design and contains all standard systems, even though not shown, since they have no immediate bearing on the present invention. A throttle 4 is located in the intake line 3 downstream of the air funnel 2. The throttle is connected via a linkage 5 in a known manner by means of a lever 6 to the displacement member 7 of an acceleration pump 8. The displacement member 7 is formed by a diaphragm. The pump chamber 9 is filled with fuel during the intake stroke from the float chamber 10 via a suction duct 12 having a suction valve 11.

Figure 2:
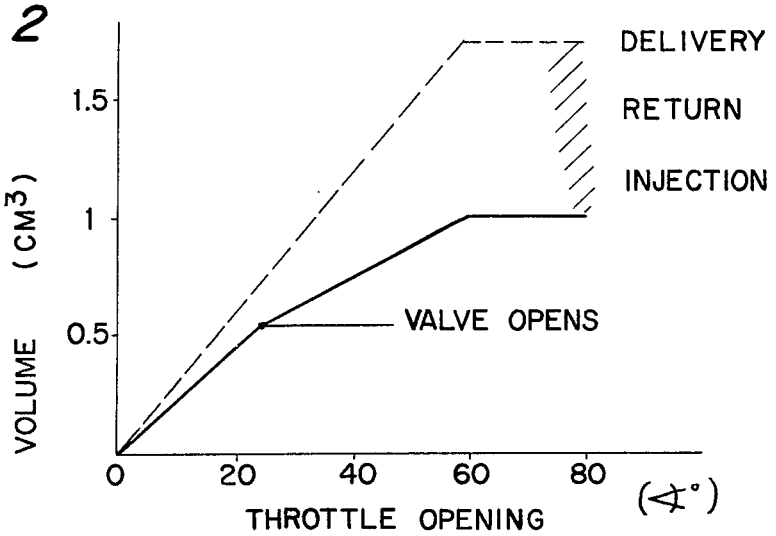
FIG. 2 shows a pump diagram.

If the throttle 4 is opened by a specific angle, the diplacement member 7 performs a pressure stroke and the fuel travels via spring-loaded pressure valve 13 and a delivery duct 14 to the intake line 3 portion upstream of the throttle 4 where the fuel is injected via a calibrated opening 15. There is a partial flow of the fuel via a flow duct 17 equipped with a pressure valve 16 preventing return flow due to vacuum pressure influence. This duct 17 is divided into two flow ducts 18, 19 which discharge into the float chamber 10. In case pressure valve 13 is an unloaded valve, ducts 18, 19 may be directly connected to the float chamber. The flow duct 18 has an adjustment screw 20 for adjusting a partial volume. FIG. 2 shows that the injected volume can be adjusted by regulating the return volume for the lower range of the opening angle of the throttle. Since the engine, after its run-up, requires a smaller injection volume than in the mentioned lower range of the opening angle of the throttle, a valve 23 which is actuated by the position of throttle 4 is located on the inlet 21 of flow duct 19 which also has a adjustment screw 22 determining the fuel flow. Valve 23 has a spring 24 which presses a closure member 26 against inlet 21, overcoming the force of the fuel pressure on a portion of diaphragm 7 abutting closure member 26, and on the other end presses a plunger 27 against a second arm 28 of lever 6 actuating the pump 8. If the throttle 4 is opened beyond an angle adjustable on linkage 5 within predetermined limits, arm 28 of lever 6 releases plunger 27 so that additional fuel may flow via duct 19 into float chamber 10 in large amounts. The curve for the injected volume in FIG. 2 clearly shows that the injected volume is greatly reduced after a predetermined opening angle of the throttle. The arrangement of valve 23 has the advantage that the flows through ducts 18, 19 can be adjusted so that the adjusted flow through one duct has no effect on the adjusted flow of the other duct.

It is obvious that the above arrangement may be combined with a known arrangement for further reducing the injected volume depending on the engine operating temperature.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A carburetor for internal combustion engines with an acceleration pump comprising: a pump chamber, a float chamber; a suction duct connection said pump chamber to said float chamber, said suction duct having a suction valve; a throttle and an intake line section upstream of said throttle; a delivery duct having a pressure valve and a calibrated injection opening, said delivery duct connecting said pump chamber to said intake line section, said acceleration pump having a displacement member; linkage means and lever means, said displacement member being actuated via said linkage means by said lever means depending on the position of said throttle; an adjustment screw; a first flow duct communicating with said delivery duct and leading to said float chamber and having a cross section adjustable by means of said screw; a second flow duct communicating with said delivery duct and having an inlet with valve means, said valve means being actuated responsive to the angular position of said throttle.

2. A carburetor as defined in claim 1 wherein level of acceleration injection is controllable so that when said throttle is open only a substantially small amount larger quantities in proportion to the opening can be injected than when the throttle is opened by a substantially larger amount, quantities of fuel being injected as a function of time dependent on the amount of throttle opening without affecting the carburetor's capacity to suppress injection pressure.

3. A carburetor for internal combustion engines with an acceleration pump comprising: a pump chamber, a float chamber; a suction duct connecting said pump chamber to said float chamber, said suction duct having a suction valve; a throttle and an intake line section upstream of said throttle; a delivery duct having a pressure valve and a calibrated injection opening, said delivery duct connecting said pump chamber to said intake line section, said acceleration pump having a displacement member; linkage means and lever means, said displacement member being actuated via said linkage means by said lever means depending on the position of said throttle; an adjustment screw; a first flow duct communicating with said delivery duct and leading to said float chamber and having a cross section adjustable by means of said screw; a second flow duct communicating with said delivery duct and having an inlet with valve means, said valve means being actuated responsive to the angular position of said throttle; spring means on said valve; a closure member pressed by said spring means; said second flow duct having an inlet; a diaphragm holding said closure member against said inlet; a plunger and a lever arm; said spring means overcoming the force of fuel pressure and pressing said plunger against said lever arm, said lever arm actuating said acceleration pump.

* * * * *